US007317164B2

(12) United States Patent
Lique et al.

(10) Patent No.: US 7,317,164 B2
(45) **Date of Patent: *Jan. 8, 2008**

(54) REDUCED ALIEN CROSSTALK ELECTRICAL CABLE WITH FILLER ELEMENT

(75) Inventors: Roger Lique, Standford, KY (US); Asef Baddar, Independence, KY (US); Thomas McLaughlin, Taylor Mill, KY (US); Mike Doorhy, Mokena, IL (US); David Hawkins, Sugar Hill, GA (US)

(73) Assignees: General Cable Technology Corp., Highland Heights, KY (US); Panduit Corp., Tinley Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/601,787

(22) Filed: Nov. 20, 2006

(65) Prior Publication Data

US 2007/0062720 A1 Mar. 22, 2007

Related U.S. Application Data

(63) Continuation of application No. 11/012,167, filed on Dec. 16, 2004, now Pat. No. 7,157,644.

(51) Int. Cl.
*H01B 7/00* (2006.01)

(52) U.S. Cl. ..... 174/113 C

(58) Field of Classification Search ..... 174/113 C, 174/131 A, 113 R

See application file for complete search history.

(56) References Cited

U.S. PATENT DOCUMENTS

| | | | |
|---|---|---|---|
| 483,285 | A | 9/1892 | Guilleaume |
| 1,008,370 | A | 11/1911 | Robillot |
| 1,654,508 | A | 12/1927 | Boggs |
| 1,673,752 | A | 6/1928 | Lewis et al. |
| 1,739,012 | A | 12/1929 | Middleton |
| 1,780,564 | A | 11/1930 | Oxer |
| 1,883,269 | A | 10/1932 | Yonkers |
| 1,976,847 | A | 10/1934 | Gordon et al. |
| 2,125,869 | A | 8/1938 | Atkinson |
| 2,455,773 | A | 12/1948 | Johnson |
| 2,538,019 | A | 1/1951 | Lee |
| 2,583,026 | A | 1/1952 | Swift |
| RE24,154 | E | 5/1956 | Krueger |
| 2,804,494 | A | 9/1957 | Fenton |

(Continued)

FOREIGN PATENT DOCUMENTS

| | | |
|---|---|---|
| EP | 0 302 162 | 4/1995 |

(Continued)

*Primary Examiner*—Chau N. Nguyen
(74) *Attorney, Agent, or Firm*—Blank Rome LLP

(57) ABSTRACT

An electrical cable that has a cable jacket defining a central longitudinal axis and at least first, second, third, and fourth twisted pairs of insulated conductors oriented longitudinally within the cable jacket and forming a core. Each of the twisted pairs of insulated conductors defines a width. A filler element is disposed in the cable jacket and located adjacent to at least one of the twisted pairs of insulated conductors. The filler element defines a width that is substantially larger than the width of each of the twisted pairs of insulated conductors. The filler element has a central axis laterally offset from the central longitudinal axis of the cable jacket, and the filler element is twisted around the core.

13 Claims, 1 Drawing Sheet

U.S. PATENT DOCUMENTS

| | | | |
|---|---|---|---|
| 2,847,499 | A | 8/1958 | Peterson |
| 3,005,739 | A | 10/1961 | Lang et al. |
| 3,032,604 | A | 5/1962 | Timmons |
| 3,086,557 | A | 4/1963 | Peterson |
| 3,102,160 | A | 8/1963 | Cook et al. |
| 3,131,469 | A | 5/1964 | Glaze |
| 3,209,064 | A | 9/1965 | Cutler |
| 3,234,722 | A | 2/1966 | Gilmore |
| 3,263,024 | A | 7/1966 | Hirsch |
| 3,274,329 | A | 9/1966 | Timmons |
| 3,324,233 | A | 6/1967 | Bryant |
| 3,622,683 | A | 11/1971 | Roberts et al. |
| 3,644,659 | A | 2/1972 | Campbell |
| 3,649,434 | A | 3/1972 | Mortenson |
| 3,649,744 | A | 3/1972 | Coleman |
| 3,650,862 | A | 3/1972 | Burr |
| 3,678,177 | A | 7/1972 | Lawrenson |
| 3,715,458 | A | 2/1973 | Bayes et al. |
| 3,761,842 | A | 9/1973 | Gandrud |
| 3,803,340 | A | 4/1974 | Jachimowiczm et al. |
| 3,843,831 | A | 10/1974 | Hutchison et al. |
| 3,881,052 | A | 4/1975 | Britz et al. |
| 3,911,200 | A | 10/1975 | Simons et al. |
| 3,921,381 | A | 11/1975 | Vogelsberg |
| 4,010,213 | A | 3/1977 | Naegeli |
| 4,034,148 | A | 7/1977 | Lang |
| 4,041,237 | A | 8/1977 | Stine et al. |
| 4,081,602 | A | 3/1978 | Paniri et al. |
| 4,085,284 | A | 4/1978 | Olszewski et al. |
| 4,096,346 | A | 6/1978 | Stine et al. |
| 4,110,554 | A | 8/1978 | Moore et al. |
| 4,131,690 | A | 12/1978 | Jukes et al. |
| 4,165,442 | A | 8/1979 | Gabriel et al. |
| 4,218,581 | A | 8/1980 | Suzuki |
| 4,234,759 | A | 11/1980 | Harlow |
| 4,262,164 | A | 4/1981 | Nutt et al. |
| 4,319,940 | A | 3/1982 | Arroyo et al. |
| 4,340,771 | A | 7/1982 | Watts |
| 4,356,345 | A | 10/1982 | Gonia |
| 4,368,214 | A | 1/1983 | Gillette |
| 4,393,582 | A | 7/1983 | Arnold, Jr. et al. |
| 4,394,705 | A | 7/1983 | Blachman |
| 4,404,424 | A | 9/1983 | King et al. |
| 4,412,094 | A | 10/1983 | Dougherty et al. |
| 4,449,012 | A | 5/1984 | Voser |
| 4,453,031 | A | 6/1984 | Justiss |
| 4,467,138 | A | 8/1984 | Brorein |
| 4,468,089 | A | 8/1984 | Brorein |
| 4,481,379 | A | 11/1984 | Bolick, Jr. et al. |
| 4,486,619 | A | 12/1984 | Trine et al. |
| 4,487,992 | A | 12/1984 | Tomita |
| 4,500,748 | A | 2/1985 | Klein |
| 4,515,993 | A | 5/1985 | MacKenzie |
| 4,541,980 | A | 9/1985 | Kiersarsky et al. |
| 4,550,559 | A | 11/1985 | Thomson |
| 4,552,432 | A | 11/1985 | Anderson et al. |
| 4,588,852 | A | 5/1986 | Fetterolf et al. |
| 4,595,793 | A | 6/1986 | Arroyo et al. |
| 4,605,818 | A | 8/1986 | Arroyo et al. |
| 4,697,051 | A | 9/1987 | Beggs et al. |
| 4,711,811 | A | 12/1987 | Randa |
| 4,755,629 | A | 7/1988 | Beggs et al. |
| 4,767,890 | A | 8/1988 | Magnan |
| 4,777,325 | A | 10/1988 | Siwinski |
| 4,800,236 | A | 1/1989 | Lemke |
| 4,873,393 | A | 10/1989 | Friesen et al. |
| 4,933,513 | A | 6/1990 | Lee |
| 4,941,729 | A | 7/1990 | Hardin et al. |
| 4,963,609 | A | 10/1990 | Anderson et al. |
| 5,010,210 | A | 4/1991 | Sidi et al. |
| 5,015,800 | A | 5/1991 | Vaupotic et al. |
| 5,103,067 | A | 4/1992 | Aldissi |
| 5,110,999 | A | 5/1992 | Barbera |
| 5,132,488 | A | 7/1992 | Tessier et al. |
| 5,142,100 | A | 8/1992 | Vaupotic |
| 5,162,609 | A | 11/1992 | Adriaenssens et al. |
| 5,202,946 | A | 4/1993 | Hardin et al. |
| 5,245,134 | A | 9/1993 | Vana, Jr. et al. |
| 5,253,317 | A | 10/1993 | Allen et al. |
| 5,283,390 | A | 2/1994 | Hubis et al. |
| 5,286,923 | A | 2/1994 | Prudhon et al. |
| 5,298,680 | A | 3/1994 | Kenny |
| 5,342,991 | A | 8/1994 | Xu et al. |
| 5,367,971 | A | 11/1994 | Carpenter et al. |
| 5,376,758 | A | 12/1994 | Kimber |
| 5,393,933 | A | 2/1995 | Goertz |
| 5,399,813 | A | 3/1995 | McNeill et al. |
| 5,401,908 | A | 3/1995 | Rodeghero |
| 5,424,491 | A | 6/1995 | Walling et al. |
| 5,434,354 | A | 7/1995 | Baker et al. |
| 5,448,669 | A | 9/1995 | Dunn et al. |
| 5,483,020 | A | 1/1996 | Haedie et al. |
| 5,493,071 | A | 2/1996 | Newmoyer |
| 5,514,837 | A | 5/1996 | Kenny et al. |
| 5,519,173 | A | 5/1996 | Newmoyer et al. |
| 5,525,757 | A | 6/1996 | O'Brien |
| 5,541,361 | A | 7/1996 | Friesen et al. |
| 5,544,270 | A | 8/1996 | Clark et al. |
| 5,574,250 | A | 11/1996 | Hardie et al. |
| 5,606,151 | A | 2/1997 | Siekierka et al. |
| 5,734,126 | A | 3/1998 | Siekierka et al. |
| 5,742,002 | A | 4/1998 | Arredondo et al. |
| 5,744,757 | A | 4/1998 | Kenny et al. |
| 5,767,441 | A | 6/1998 | Brorein et al. |
| 5,770,820 | A | 6/1998 | Nelson et al. |
| 5,789,711 | A | 8/1998 | Gaeris et al. |
| 5,814,768 | A | 9/1998 | Wessels et al. |
| 5,821,466 | A | 10/1998 | Clark et al. |
| 5,834,697 | A | 11/1998 | Baker et al. |
| 5,883,334 | A | 3/1999 | Newmoyer et al. |
| 5,900,588 | A | 5/1999 | Springer et al. |
| 5,932,847 | A | 8/1999 | Mayfield |
| 5,936,205 | A | 8/1999 | Newmoyer |
| 5,952,607 | A | 9/1999 | Friesen et al. |
| 5,952,615 | A | 9/1999 | Prudhon |
| 5,956,445 | A | 9/1999 | Deitz, Sr. et al. |
| 5,969,295 | A | 10/1999 | Boucino et al. |
| 5,990,419 | A | 11/1999 | Bogese, II |
| 6,037,546 | A | 3/2000 | Mottine et al. |
| 6,064,008 | A | 5/2000 | Craton |
| 6,066,799 | A | 5/2000 | Nugent |
| 6,074,503 | A | 6/2000 | Clark et al. |
| 6,091,025 | A | 7/2000 | Cotter et al. |
| 6,101,305 | A | 8/2000 | Wagman et al. |
| 6,139,957 | A | 10/2000 | Craton |
| 6,140,587 | A | 10/2000 | Sackett |
| 6,150,612 | A | 11/2000 | Grandy et al. |
| 6,153,826 | A | 11/2000 | Kenny et al. |
| 6,162,992 | A | 12/2000 | Clark et al. |
| 6,194,663 | B1 | 2/2001 | Friesen et al. |
| 6,211,467 | B1 | 4/2001 | Berelsman et al. |
| 6,222,129 | B1 | 4/2001 | Siekierka et al. |
| 6,222,130 | B1 | 4/2001 | Gareis et al. |
| 6,239,379 | B1 | 5/2001 | Cotter et al. |
| 6,248,954 | B1 | 6/2001 | Clark et al. |
| 6,255,593 | B1 | 7/2001 | Reede |
| 6,259,031 | B1 | 7/2001 | Totland et al. |
| 6,288,340 | B1 | 9/2001 | Arnold |
| 6,297,454 | B1 | 10/2001 | Gareis |
| 6,300,573 | B1 | 10/2001 | Horie et al. |
| 6,310,295 | B1 | 10/2001 | Despard |
| 6,323,427 | B1 | 11/2001 | Rutledge |
| 6,342,678 | B1 | 1/2002 | Knop et al. |
| 6,353,177 | B1 | 3/2002 | Young |

6,365,836 B1 4/2002 Blouin et al.
6,433,272 B1 8/2002 Buhler et al.
6,448,500 B1 9/2002 Hosaka et al.
6,452,105 B2 9/2002 Badii et al.
6,462,268 B1 10/2002 Hazy et al.
6,465,737 B1 10/2002 Bonato et al.
6,476,326 B1 11/2002 Fuzier et al.
6,506,976 B1 1/2003 Neveux, Jr.
6,534,715 B1 3/2003 Maunder et al.
6,545,222 B2 4/2003 Yokokawa et al.
6,566,605 B1 5/2003 Prudhon
6,566,607 B1 5/2003 Walling
6,570,095 B2 5/2003 Clark et al.
6,573,456 B2 6/2003 Spruell et al.
6,596,944 B1 7/2003 Clark et al.
6,624,359 B2 9/2003 Bahlmann et al.
6,639,152 B2 10/2003 Glew et al.
6,687,437 B1 2/2004 Starnes et al.
6,710,243 B2 3/2004 Kao
6,713,673 B2 3/2004 Kao
6,743,983 B2 6/2004 Wiekhorst et al.
6,770,819 B2 8/2004 Patel
6,787,697 B2 9/2004 Stipes et al.
6,800,811 B1 10/2004 Boucino
6,812,408 B2 11/2004 Clark et al.
6,818,832 B2 11/2004 Hopkinson et al.
6,855,889 B2 2/2005 Gareis
6,875,928 B1 4/2005 Hayes et al.
6,888,070 B1 5/2005 Prescott
7,157,644 B2 * 1/2007 Lique et al. ..... 174/113 C
2001/0001426 A1 5/2001 Gareis et al.
2001/0040042 A1 11/2001 Stipes
2002/0079126 A1 6/2002 Valenzuela
2003/0070831 A1 4/2003 Hudson
2003/0106704 A1 6/2003 Isley et al.
2003/0121695 A1 7/2003 Wiebelhaus et al.
2003/0132021 A1 7/2003 Gareis
2003/0205402 A1 11/2003 Koyasu et al.
2003/0217863 A1 11/2003 Clark et al.
2003/0230427 A1 12/2003 Gareis
2004/0035603 A1 2/2004 Clark et al.
2004/0050578 A1 3/2004 Hudson
2004/0055777 A1 3/2004 Wiekhorst et al.
2004/0055779 A1 3/2004 Wiekhorst et al.
2004/0055781 A1 3/2004 Comibert et al.
2004/0118593 A1 6/2004 Augustine et al.
2004/0149483 A1 8/2004 Glew
2004/0149484 A1 8/2004 Clark
2004/0256139 A1 12/2004 Clark
2005/0006132 A1 1/2005 Clark
2005/0023028 A1 2/2005 Clark
2005/0029007 A1 2/2005 Nordin et al.
2005/0045367 A1 3/2005 Somers et al.
2005/0051355 A1 3/2005 Bricker et al.
2005/0087360 A1 4/2005 Speer
2005/0092514 A1 5/2005 Kenny et al.
2005/0092515 A1 5/2005 Kenny et al.
2005/0103518 A1 5/2005 Glew
2005/0167149 A1 8/2005 Prescott
2005/0167151 A1 8/2005 Kenny et al.
2005/0189135 A1 9/2005 Clark
2005/0199415 A1 9/2005 Glew
2005/0205289 A1 9/2005 Kenny et al.

FOREIGN PATENT DOCUMENTS

EP 999557 * 10/1999
GB 694100 11/1930
GB 1 390 152 4/1975
GB 2 120 836 A 12/1983
JP 06349344 A 12/1994

* cited by examiner

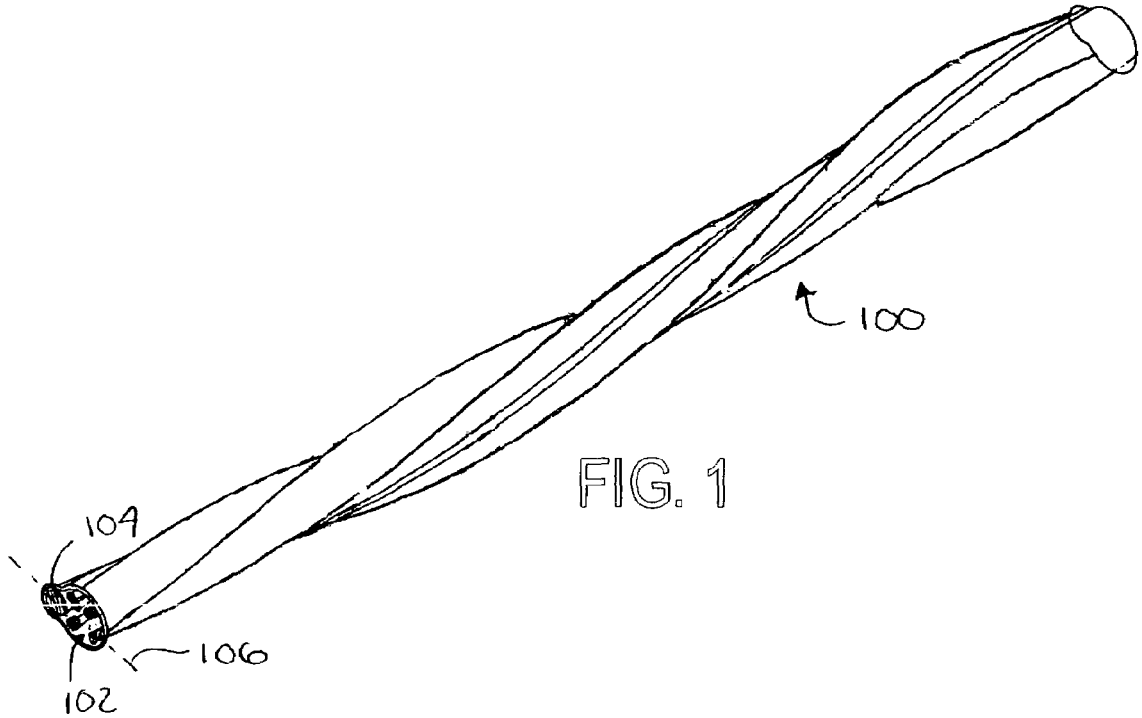
FIG. 1
FIG. 2
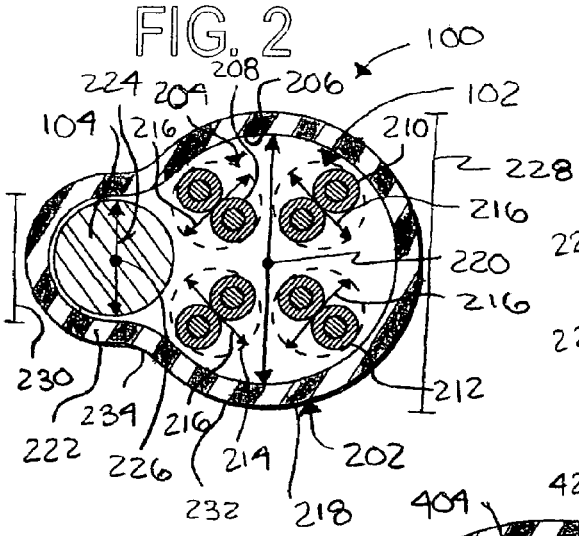
FIG. 3
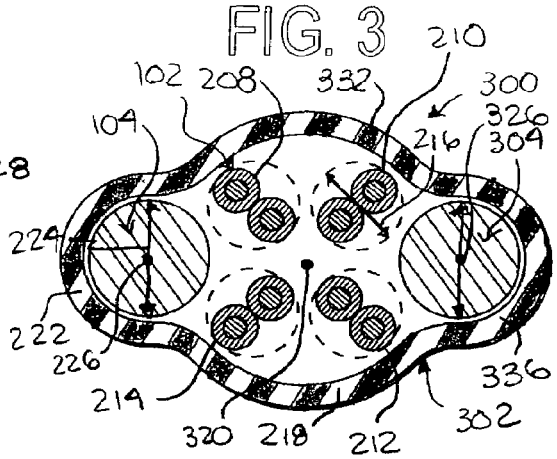
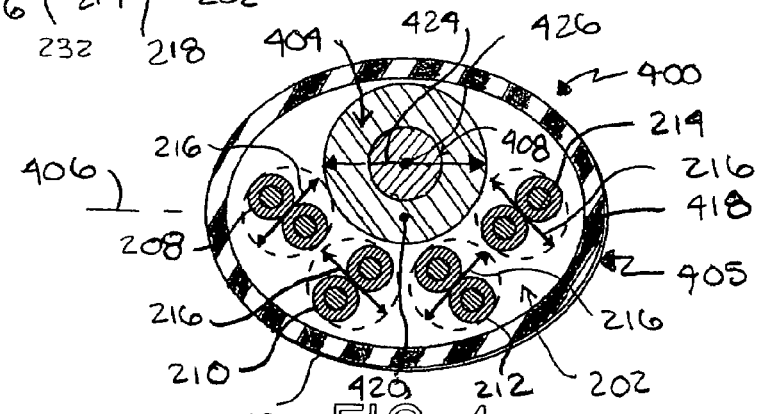
FIG. 4

REDUCED ALIEN CROSSTALK ELECTRICAL CABLE WITH FILLER ELEMENT

RELATED APPLICATIONS

This application is a continuation of commonly owned, currently, U.S. patent application Ser. No. 11/012,167, filed Dec. 16, 2004, now U.S. Pat. No. 7,157,644 entitled Reduced Alien Crosstalk Electrical Cable With Filler Element, the subject matter of which is herein incorporated by reference.

FIELD OF THE INVENTION

The present invention relates to an electrical cable that reduces alien crosstalk between cables. More specifically, a filler element disposed in the electrical cable reduces alien crosstalk between adjacent cables.

BACKGROUND OF THE INVENTION

Interference between electrical cables bundled together in a cabling system decreases the efficiency of data transmission by the cabling system. Alien near-end crosstalk (ANEXT) and alien far-end crosstalk (AFEXT) noise is caused by the electrical unbalance between the twisted pairs of insulated conductors of adjacent cables. ANEXT and AFEXT are transmission noises that can increase the signal to noise ratio (SNR) and bit error rate (BER) in a cable transmission system, such as for a local area network.

Specifically, ANEXT and AFEXT occur when some of the signal current in a twisted pair of one cable couples with another twisted pair of another cable external to the signal path and along the path of a circuit between the two pairs. That noise corrupts the signal in the twisted pair external to the original signal path. When the circuit between the noise emitting and receiving twisted pairs egresses one cable boundary and crosses another cable boundary, the noise becomes alien crosstalk.

SUMMARY OF THE INVENTION

According to the present invention, there is provided an electrical cable that includes a cable jacket defining a central longitudinal axis and a plurality of twisted pairs of insulated conductors oriented longitudinally within the cable jacket. Each of the twisted pairs of insulated conductors has a width. A filler element is disposed in the cable jacket and is located adjacent to at least one of the twisted pairs of insulated conductors. The filler element defines a width that is substantially larger than the width of each the twisted pairs of insulated conductors. The filler element has a central axis laterally offset from the central longitudinal axis of the cable jacket. The filler element reduces alien crosstalk from an adjacent cable.

The present invention also provides an electrical cable that includes a cable jacket that defines a central longitudinal axis and a substantially non-circular outer perimeter. A plurality of twisted pairs of insulated conductors are oriented longitudinally within the cable jacket. Each of the twisted pairs of insulated conductors has a width. A filler element is disposed in the cable jacket and located adjacent to at least one of the twisted pairs of insulated conductors. The filler element has a central axis laterally offset from the central longitudinal axis of the cable jacket. The filler element is substantially circular in section transverse to the central axis and defines a diameter that is substantially larger than the width of each the twisted pairs of insulated conductors. The filler element reduces alien crosstalk from an adjacent cable.

Advantages and salient features of the invention will become apparent from the following detailed description, which, taken in conjunction with the annexed drawings, discloses preferred embodiments of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a drawing of a perspective view of an electrical cable according to a first embodiment of the present invention;

FIG. 2 is a drawing of an elevational view in section of the electrical cable illustrated in FIG. 1, showing a plurality of twisted pairs of insulated conductors and a filler element enclosed by a cable jacket;

FIG. 3 is a drawing of an elevational view in section of an electrical cable according to a second embodiment of the present invention; and FIG. 4 is a drawing of an elevational view in section of an electrical cable according to a third embodiment of the present invention.

DETAILED DESCRIPTION OF THE INVENTION

Referring to FIGS. 1 and 2, an electrical cable 100 according to a first embodiment of the present invention includes a plurality of twisted pairs of insulated conductors 102 and a filler element 104 for reducing alien crosstalk between adjacent cables. More specifically, the filler element 104 increases the cable diameter along one axis 106 of the cable 100 cross-section, effectively increasing the net distance between the pairs of insulated conductors 102 in the cable 100 from twisted pairs of insulated conductors of an adjacent cable (not shown).

As seen in FIG. 2, the electrical cable 100 has a cable jacket 202 that encloses the filler element 104 and the plurality of twisted pairs of insulated conductors 102 in an inner area 204 defined by the inner perimeter 206 of the cable jacket 202. Although the plurality of twisted pairs of insulated conductors 102 preferably include four pairs of insulated conductors 208, 210, 212, and 214, the electrical cable 100 can include any number of twisted pairs of insulated conductors. The cable jacket 202 can be formed of a dielectric material, such as PVC, TA-910, or polyolefin low smoke zero halogen.

Each twisted pair of insulated conductors 208, 210, 212, and 214 defines a width 216 and is supported in a first region 218 of the cable jacket 202. The cable jacket 202 defines a generally central longitudinal axis 220. The cable 100 can be twisted about the central longitudinal axis 220, as seen in FIG. 1. A second region 222 supports the filler element 104. The filler element 104 has a generally cylindrical rod shape, with a substantially circular cross-sectional shape, and defines a width or diameter 224 and has a central axis 226. The first and second regions 218 and 222 are generally continuous.

The width 228 of the first region 218 is substantially larger than the width 230 of the second region 222, thereby creating an uneven or lopsided outer perimeter 232 of the cable jacket 202, such that the shape of the electrical connector 100 in section transverse to the longitudinal axis 220 is substantially non-circular, as seen in FIG. 2. Preferably, the width 228 of the first region 218 is about twice the width 230 of the second region 222. However, the width 228 of the first region 218 can be any size with respect to width 230 of the second region 222, such as the same as or slightly larger than the width 230 of the second region 222, as long as the first region 218 can accommodate the twisted pairs of insulated conductors 102 and the second region 222 can accommodate the filler element 104. The outer perimeter 232 is asymmetrical and defines a transition area 234 between the larger first region 218 and the smaller second region 222.

The width 224 of the filler element 104 is substantially larger than the width 216 of each of the twisted pairs of insulated conductors 208, 210, 212 and 214. The central axis 226 of the filler element 104 is laterally offset from the central longitudinal axis 220 of the cable 100. By offsetting the axes 220 and 226 of the cable 100 and the filler element 104, respectively, and due to the size of the filler element 104, the diameter of the cable 100 along the axis 106 is increased. Because the width 224 of the filler element 104 is larger than the width 216 of the individual pairs of insulated conductors 208, 210, 212 and 214, the pairs 208, 219, 212 and 214 are prevented from encircling the filler element 104, thereby preventing coaxial alignment of the central axis 226 of the filler element 104 and the central longitudinal axis 220 of the electrical cable 100. Thus the non-circular cross-sectional shape of the electrical cable 100 is maintained. The lopsided shape and the increased diameter along the axis 106 of the electrical cable reduces alien crosstalk between adjacent cables 100 by increasing the distance from the twisted pairs of insulated conductors of the adjacent cables 100.

Although the filler element 104 is preferably shaped as a cylindrical rod, the filler element 104 can have any circular, elliptical or polygonal shape in cross-section. The filler element 104 can be formed of a single material or multiple materials. For example, the filler element 104 can be made of a dielectric material, such as polypropylene, polyolefin insulation, rigid PVC insulation, or low smoke PVC insulation. Alternatively, the filler element 104 can be made of both dielectric and conductive materials. For example, the filler element 104 can be formed with a copper core and any one of FEP insulation or fluoropolymers, low smoke PVC insulation, rigid insulation, polyolefin insulation, or polypropylene insulation.

Referring to FIG. 3, an electrical cable 300 in accordance with a second embodiment of the present invention is the same as the electrical cable 100 of the first embodiment, except a second filler element 304 is disposed in a third region 336 of the cable jacket 302. The third region 336 is substantially the same size as the second region 222 and the second filler element 304 is substantially the same size as the first filler element 104. The outer perimeter 332 of the cable jacket 302 is uneven with a non-circular cross-section; however, unlike the first embodiment, the outer perimeter is substantially symmetrical about a vertical axis of FIG. 3. Like the filler element 104, the second filler element 304 has a central axis 326 that is offset from the central longitudinal axis 320 of the cable 300. The second filler element 304 further increases the distance between neighboring cables along axis 106 to reduce alien crosstalk caused by an adjacent cable.

Referring to FIG. 4, an electrical cable 400 in accordance with a fourth embodiment of the present invention includes a filler element 404 and the plurality of twisted pairs of insulated conductors 202 supported in a cable jacket 405. The filler element 404 is similar to the filler element 104, except that it is larger, preferably about twice the width 216 of each twisted pair of insulated conductors 208, 210, 212 and 214. Unlike the cables 100 and 300 of the first and second embodiments, the cable jacket 405 of the cable 400 includes a single region 418 for supporting the filler element 404 and the plurality of twisted pairs 202. The filler element 404 also includes a conductive core 408.

Like the cables 100 and 300 of the first and second embodiments, the cross-sectional shape of the cable 400 is non-circular, such as an elliptical shape. The non-circular shape of the cable 400 defines an even outer perimeter 432 of the cable jacket 406. The non-circular cross-sectional shape of the cable jacket 406 increases the diameter of the cable 400 along one axis 406 of the cable 400. A central axis 426 of the filler element 404 is offset from the central longitudinal axis 420 of the cable 400. Since the width or diameter 424 of the filler element 404 is about twice the width 216 of each twisted pair of insulated conductors 208, 210, 212, and 214, the pairs 208, 210, 212, and 214 are prevented from encircling the filler element 404, so that the filler element 404 remains offset from the central longitudinal axis 420 of the cable 400. Similar to the first and second embodiments, by fashioning the cable 400 in this manner, the distance between twisted pairs of insulated conductors of adjacent cables is increased, thereby reducing alien crosstalk.

While particular embodiments have been chosen to illustrate the invention, it will be understood by those skilled in the art that various changes and modifications can be made therein without departing from the scope of the invention as defined in the appended claims. For example, any number of filler elements can be employed with the cable including one, two, or more than two filler elements.

What is claimed is:

1. An electrical cable, comprising a cable jacket defining a central longitudinal axis;

at least first, second, third, and fourth twisted pairs of insulated conductors oriented longitudinally within said cable jacket and forming a core, each of said twisted pairs of insulated conductors defining a width; and a filler element disposed in said cable jacket and located adjacent to at least one of said twisted pairs of insulated conductors, said filler element defining a width that is substantially larger than said width of each said twisted pairs of insulated conductors, said filler element having a central axis laterally offset from said central longitudinal axis of said cable jacket, and said filler element being twisted around said core, and said filler element being devoid of insulated conductors.

2. An electrical cable according to claim 1, wherein said cable jacket has an asymmetrical shape.

3. An electrical cable according to claim 1, wherein said filler element is a solid, unitary one-piece member.

4. An electrical cable, comprising a cable jacket defining a central longitudinal axis, said cable jacket having an asymmetrical shape;

a plurality of twisted pairs of insulated conductors oriented longitudinally within said cable jacket and forming a core, each of said twisted pairs of insulated conductors defining a width; and a filler element disposed in said cable jacket and located adjacent to at least one of said twisted pairs of insulated conductors, said filler element defining a width that is substantially larger than said width of each said twisted pairs of insulated conductors, said filler element having a central axis laterally offset from said central longitudinal axis of said cable jacket, and said filler element being twisted around said core.

5. An electrical cable according to claim 4, wherein said plurality of twisted pairs of insulated conductors includes at least first, second, third and fourth pairs of insulated conductors.

6. An electrical cable according to claim 4, wherein said filler elements is a solid, unitary one-piece member.

7. An electrical cable according to claim 4, wherein said filler element is devoid of insulated conductors.

8. An electrical cable, comprising a cable jacket defining a central longitudinal axis;

a plurality of twisted pairs of insulated conductors oriented longitudinally within said cable jacket, each of said twisted pairs of insulated conductors defining a width; and a filler element disposed in said cable jacket and located adjacent to at least one of said twisted pairs of insulated conductors, said filler element defining a width that is substantially larger than said width of each said twisted pairs of insulated conductors, said filler element having a central axis laterally offset from said central longitudinal axis of said cable jacket, and said filler element being twisted around said plurality of twisted pairs of insulated conductors that together with said plurality of twisted pairs of insulated conductors forms a core that has an asymmetrical shape, said filler element being devoid of insulated conductors.

9. An electrical cable according to claim 8, wherein said plurality of twisted pairs of insulated conductors includes at least first, second, third and fourth pairs of insulated conductors.

10. An electrical cable according to claim 8, wherein said cable jacket having an asymmetrical shape.

11. An electrical cable according to claim 8, wherein said filler elements is a solid, unitary one-piece member.

12. An electrical cable, comprising a cable jacket defining a central longitudinal axis, said cable jacket having an asymmetrical shape;

at least first, second, third, and fourth twisted pairs of insulated conductors oriented longitudinally within said cable jacket and forming a core, each of said twisted pairs of insulated conductors defining a width; and a filler element disposed in said cable jacket and located adjacent to at least one of said twisted pairs of insulated conductors, said filler element defining a width that is substantially larger than said width of each said twisted pairs of insulated conductors, said filler element having a central axis laterally offset from said central longitudinal axis of said cable jacket, and said filler element being twisted around said core.

13. An electrical cable, comprising a cable jacket defining a central longitudinal axis;

at least first, second, third, and fourth twisted pairs of insulated conductors oriented longitudinally within said cable jacket and forming a core, each of said twisted pairs of insulated conductors defining a width; and a filler element disposed in said cable jacket and located adjacent to at least one of said twisted pairs of insulated conductors, said filler element defining a width that is substantially larger than said width of each said twisted pairs of insulated conductors, said filler element having a central axis laterally offset from said central longitudinal axis of said cable jacket, and said filler element being twisted around said core, and said filler element being a solid, unitary one-piece member.

* * * * *